United States Patent [19]

Miyasaka et al.

[11] 3,940,922

[45] Mar. 2, 1976

[54] NONCIRCULAR WATCH CASE

[75] Inventors: Tsutomu Miyasaka; Akio Ishiyama, both of Suwa, Japan

[73] Assignee: Kabushiki Kaisha Suwa Seikosha, Tokyo, Japan

[22] Filed: Dec. 18, 1974

[21] Appl. No.: 534,109

[30] Foreign Application Priority Data

Dec. 18, 1973 Japan ..... 48-142254

[52] U.S. Cl. ..... 58/90 R

[51] Int. Cl.[2] ..... G04B 37/08

[58] Field of Search ..... 58/90 R, 91, 88 R

[56] References Cited

UNITED STATES PATENTS

| | | | |
|---|---|---|---|
| 3,264,820 | 8/1966 | Piquarez | 58/90 R |
| 3,782,105 | 1/1974 | Nozawa | 58/90 R |

*Primary Examiner*—George H. Miller, Jr.

*Attorney, Agent, or Firm*—Blum Moscovitz Friedman & Kaplan

[57] ABSTRACT

A noncircular watch case is provided which includes a case body underlying and supporting a noncircular crystal. A pin and crown arrangement is mounted in the case body and is operatively connected to the watch movement for performing a plurality of functions. Fixedly connected at its ends to the back cover of the watch is a spring member which is releasably connected to the case body interior. For releasing the case body and crystal mounted therein from its connection to the spring and back cover, the case body is provided with a lug which is fixedly mounted thereon. An upward pressure may be manually applied to the lug, while the back cover is held in fixed position for releasing the spring from its preselected setting in a groove of predetermined incline in the case body.

7 Claims, 12 Drawing Figures

FIG. 3
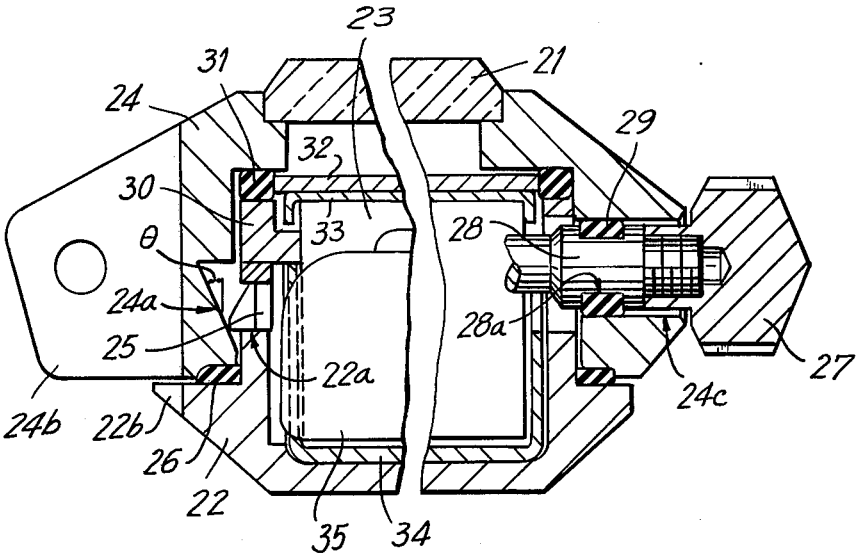
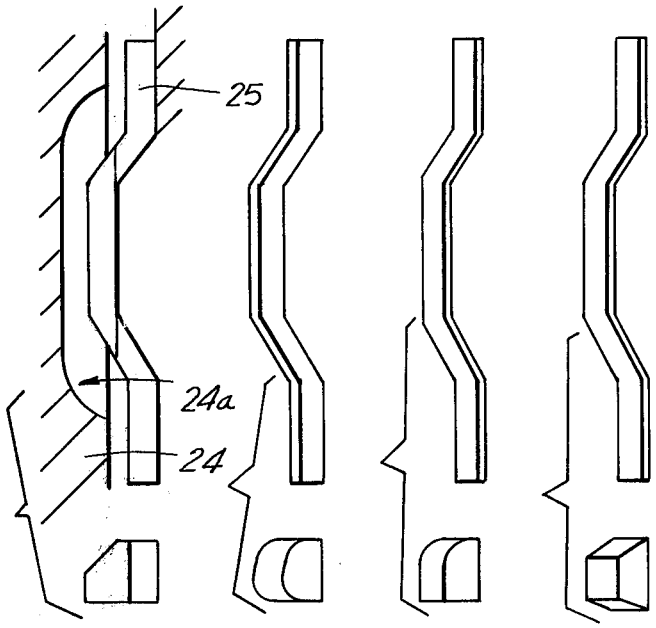
FIG.4a FIG.4b FIG.4c FIG.4d

FIG.5
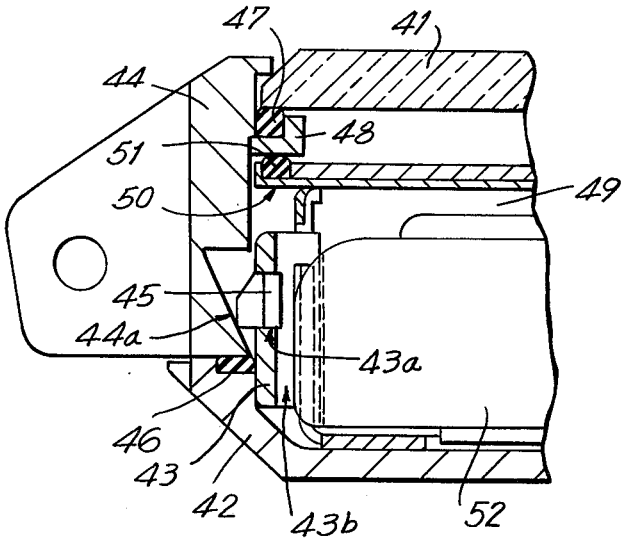
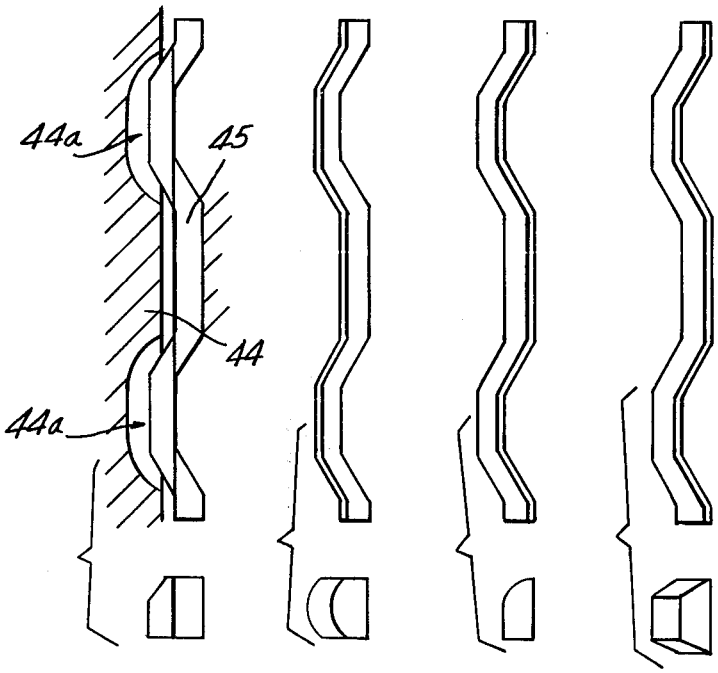
FIG.6a FIG.6b FIG.6c FIG.6d

NONCIRCULAR WATCH CASE

BACKGROUND OF THE INVENTION

This invention relates to a watch case construction, and more particularly to a watch case construction for a noncircular watch.

Prior watch cases and noncircular watches have been bulky and difficult to assemble and disassemble. These watch cases have generally also been of substantial depth, thereby providing a watch of undesirably thick appearance.

Accordingly, the instant invention provides a novel watch case construction for a noncircular watch and is in general of lesser depth and width than prior noncircular watch cases. It is also found that the instant watch case may be easily assembled or disassembled, and ready access to the watch movement therein may be had.

SUMMARY OF THE INVENTION

Generally speaking, in accordance with the invention, a noncircular watch case is provided which includes a case body underlying and supporting a noncircular crystal. A pin and crown arrangement is mounted in the case body and is operatively connected to a watch movement housed therein. A plurality of pin positions are provided for performing various timekeeping functions. Fixedly connected at its ends to the back cover of the watch case is a configured flat spring member which releasably connects the case body of the watch to the back cover thereof. The case body of the watch overlies the spring mounting.

For releasing the case body and crystal mounted therein from its connection to the spring and back cover, the case body is provided with a lug which is fixedly mounted thereon. An upward pressure may be manually applied to the lug, while the back cover is held in a fixed position. The upward pressure releases the flat spring from its preselected setting in a groove of predetermined incline provided in the case body.

Accordingly, it is an object of this invention to provide a novel noncircular watch case.

Another object of the invention is to provide a relatively flat, compact watch case for a noncircular watch.

A further object of the invention is to provide a noncircular watch case which is easy to assemble and dissassemble and which provides ready access to the movement housed therein.

Still other objects and advantages of the invention will in part be obvious and will in part be apparent from the specification.

The invention accordingly comprises the features of construction, combinations of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings in which:

FIG. 3 is a sectional view of a noncircular watch case constructed in accordance with the invention;

FIG. 4 is a plan detail view of the configured flat spring member employed in the embodiment shown in FIG. 3 for releasably connecting the case body to the back cover of the noncircular watch case;

FIG. 5 is a fragmentary sectional view of another noncircular watch case constructed in accordance with the instant invention; and FIG. 6 is a plan detail view of the flat spring and inclined groove arrangement employed in the embodiment seen in FIG. 5 for releasably connecting the case body to the back cover of the noncircular watch case.

DETAILED DESCRIPTION OF THE INVENTION

Figure 1:
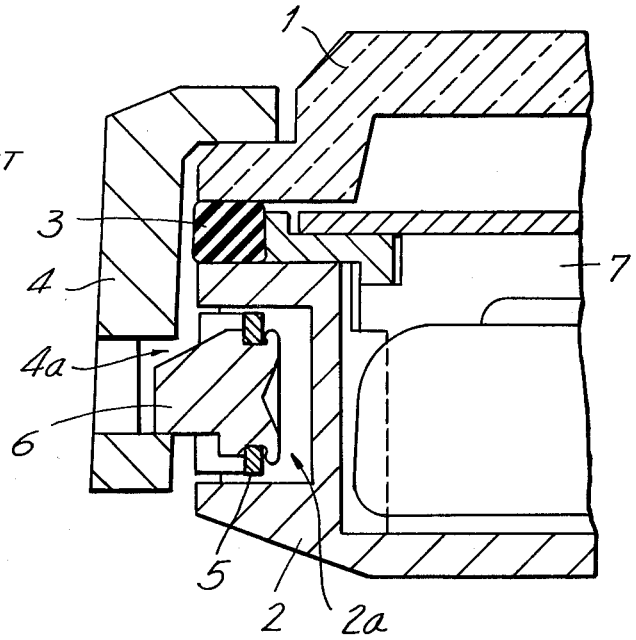
FIG. 1 PRIOR ART
FIG. 1 is a fragmentary sectional view of a prior noncircular watch case construction.

Referring now to FIG. 1 which illustrates one embodiment of a prior noncircular watch case construction, a gasket 3 overlies a stepped up flange provided in a back cover 2 and underlies the rim of crystal 1 for thereby providing a watertight seal therebetween. A pin 6 mounted in a leaf spring 5 is housed in a recess 2*a*of back cover 2. Pin 6 is spring biased into an aperture 4*a* provided in noncircular outer case body 4 which thereby axially inwardly compresses crystal 1 and back cover 2 into gasket 3 for watertightly sealing crystal 1 against back cover 2.

In this type construction, however, the watch winding crown (not shown) is operatively connected to the movement 7 through back cover 2, and the crown must be pulled to its outer most position before access to movement 7 or the battery which powers the movement may be had. This is an undesirable feature of this type construction.

In a modification of this construction, a hinged battery access door may be provided on back cover 2. However, the thickness of back cover 2 must be substantially increased to accommodate the door, and the door construction substantially increases the unit cost of the item as well as production time.

An additional undesirable feature of this type construction involves the use of spring mounted pin 6 and pin groove 4*a*. As leaf spring 5 loses resiliency, the watertight compression of crystal 1 against back cover 2 diminishes. It is also possible that pin groove 4*a* may become enlarged as pin 6 wears in the groove, thereby diminishing the watertight compression of crystal 1 and back cover 2 against gasket 3.

Yet another disadvantage of this type of construction is related to the gap provided between noncircular outer case body 4 and back cover 2 whereby moisture such as perspiration may filter into and remain in the gap, and eventually that water may affect the watertightness and corrosion resistance of the time piece members.

Figure 2:
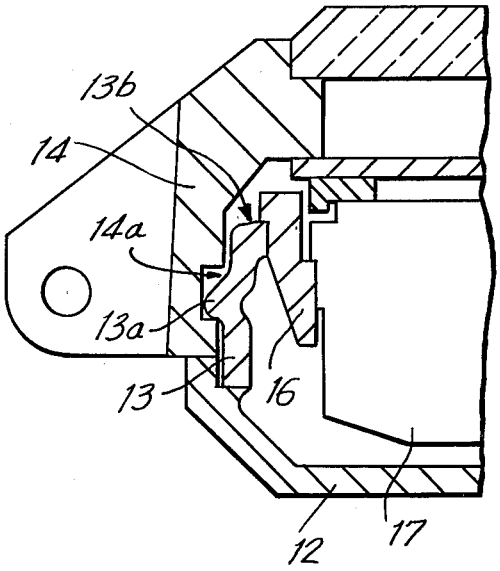
FIG. 2 PRIOR ART
FIG. 2 is a fragmentary sectional view of another embodiment of a prior noncircular watch case construction.

Referring now to FIG. 2 which shows another embodiment of a different prior noncircular watch case construction, a core 13 mounted on a noncircular back cover 12 releasably connects the case body 14 and crystal mounted therein to the back cover 12. Core 13 is provided with a dowel 13*a* which releasably connects in a recess 14*a* of case body 14. Dowel 13*a* and case body 14 are both rigid, therefore plastic deformation occurs during assembly and disassembly of case body 14 on back cover 12 and either dowel 13*a* or side walls of recess 14*a* become worn. The stability of the releasable connection between back cover 12 and case body 14 thereby diminishes over the useful life of the watch. An additional undesirable feature of this type construction is the accuracy required in fabricating dowel 13*a* in core 13 for an accurate fit in recess 14*a*. Yet another undesirable feature of this type construction is that support 13*b* of core 13 engages under the lip flange provided on frame 16 for suitably locating movement 17 within the casing housing. Deformation of support 13*b* or frame 16 may result in improper placement of movement 17 within the casing housing and thereby affect the timekeeping accuracy thereof.

Noncircular watch case constructions within the scope of the instant invention overcome the inherent defects of the hereinbefore described prior embodiments. Referring now to FIGS. 3 and 4, a noncircular crystal 21 is adhesively connected to a frame therefor provided in a case body 24. A noncircular back cover 22 is releasably connected to case body 24 so that access to the timepiece movement 23 may be had. The releasable connection between back cover 22 and case body 24 is provided by a configured flat spring member 25 as best seen in FIGS. 4(*a*) - (*d*). Spring 25 is loaded in a spring groove 22*a* provided therefor in back cover 22. Opposed ends of spring 25 are linearly flanged and fixedly connected to a supporting wall of back cover 22, for instance by a spot weld or a caulk. The mid portion of spring 25 is permanently depressed outwardly in at least one segment thereof to biasingly engage side walls of at least one inclined groove 24*a* predetermined dimensions provided in case body 24. In the particular flat spring embodiment 25 seen in FIG. 4, which is employed in the construction illustrated in FIG. 3, the spring segments connected to the opposed linear flanges are respectively obtusely inclined therefrom and connected in a substantially linear spring segment which is substantially parallel to the respective flanges. When this type of spring construction is employed, only one inclined groove 24*a* of specific dimensions is provided in case body 24. It is, however, understood that the specific configuration of the interior spring segments may be altered into a variety of suitable modes so long as there is a suitable releasable bias between spring 25 and inclined groove 24*a* therefor.

Between case body 24 and back cover 22 is a gasket 26 into which both respective members are compressed for thereby providing a watertight seal therebetween. Gasket 26 sits on a flange extension provided in back cover 22 and the rim of case body 24 sits thereon. The bias between spring 25 and inclined groove 24*a* vertically downwardly compresses case body 24 into gasket 26 which is seated on back cover 22. The angle of incline of groove 24*a* and the resilience of gasket 26 are predetermined so that the vector of vertical compression of spring 25 against case body 24 is greater than the force of compression of gasket 26 against back cover 22. In practice, it is preferable that the angle of incline, $\theta$, of groove 24*a* to the vertical be between about 5° to about 45°, and that the concomitant hardness of gasket 26 be from about 40 to 60 Mohs.

For operating the timepiece, a winding crown 27 is fixedly connected to a rotatable winding stem 28. Stem 28 is operatively connected to the watch movement 23 through a slot 24*c* provided in case body 24. In a groove seat 28*a* of stem 28, a gasket 29 is mounted which frictionally engages the side wall of groove 24*c* as stem 28 is moved to various operational positions.

Movement 23 is secured in the casing housing by a frame and gasket arrangement. Frame 30 in which movement 23 sits is mounted on back cover 22 and on the upturned rim thereof gasket 31 is mounted. When back cover 22, including frame 30 and gasket 31, is releasably connected in case body 24, gasket 31 engages against an interior continuous elbow provided in case body 24. Overlying movement 23 and operatively connected thereto is a dial disc 32 which rests on a frame 33 mounted on movement 23. Frame 33 is preferably fabricated of a highly permeable material. In the interior recess of back cover 22, a magnetically resistant frame 34 is mounted, frame 34 being preferably fabricated of a highly permeable material. In frame 34, a battery 35 for operating movement 23 is mounted.

For opening the watch case to thereby obtain access to movement 23, a projection 22*b* is provided on back cover 22. To provide a manually fixed support for the case while the back cover 22 thereof is being separated therefrom by a manual pressure exerted on projection 22*b*, a lug 24*b* is provided on case body 24 proximately projection 22*b* so as to provide a fulcrum effect as back cover 22 is levered open.

Referring now to FIGS. 5 and 6 which illustrate another emobidment within the scope of the invention, the back cover 42 is plurally releasably biased into connection with case body 44. As best seen in FIG. 6, a flat configured spring 45 is provided with a pair of raised portions and a respective pair of inclined grooves 44*a* is provided therefor in case body 44. Opposed ends of spring 45 are linearly flanged and are fixedly connected to back cover 42, for instance in the manner previously described in connection with the embodiment of FIG. 3. Respective pairs of interior segments of spring 45 are acutely angularly oriented relative to each other for defining the raised portions of the spring. The segment connecting each respective pair of acutely oriented segments is substantially linear. As heretofore discussed, the raised portions of spring 45 may have a variety of shapes. Upstanding in an interior elbow provided in back cover 42 is a frame 43 provided with a slot 43*a* through which raised portions of the spring 45 project into inclined grooves 44*a* therefor in case body 44. The unraised linear central portion of spring 45 is connected to back cover 42, for instance by brazing.

For each raised portion of the spring, a respective inclined groove 44*a* is provided on the case body interior. As hereinbefore described in connection with the embodiment of FIG. 3, the angle of incline of each groove 44*a* is preferably between 5° and 45° and the concomitant hardness of gasket 46 is preferably from about 40 to about 60 Mohs.

In this embodiment, the top of case body 44 is provided with a lateral lip which overlies the beveled edge of crystal 41. Under crystal 41 and mounted to the interior side wall of case body 44 is a frame 48 having an upturned elbow and thereby defining a seat in which a gasket 47 is loaded for securing crystal 41 against the lip provided on case body 44. Since the gasket seat defined by frame 48 is noncircular, from a construction standpoint, it may be preferable to mount frame 48 on cover 42 rather than case body 44.

In the embodiment seen in FIG. 5, a movement 49 is mounted in the casing housing on frame 43. Overlying movement 49 is a frame 50 in which the dial disc is mounted. Preferably, the dial disc is fabricated of a highly permeable material. In a gasket seat provided around the perimeter of frame 50, a gasket 51 is mounted. However, the upstanding rim of frame 50 may be elongated and engaged against frame 48, without employing gasket 51. Underlying movement 49 is a recess in the casing housing in which a battery 52 may be mounted for providing power to the movement.

The shape of the movement employed may in part determine the configuration of the flat spring employed for releasably connecting the back cover and case body. For instance, when the movement is rectangular, a spring having the configuration of FIG. 6 may be employed. However, when the movement is substantially or partially circular, but the case body is noncircular, then it may be desirable to employ a flat spring which has a substantially curved configuration throughout its length.

Therefore, it is understood that the instant invention may be employed in connection with any shape movement that may be installed in a noncircular watch case housing. As a result, a casing of highly desirable aesthetic appearance and compactness may be fabricated. It is also found that watch cases constructed according to the instant invention are of substantially reduced thickness and as a result thereof the watch may be miniaturized relative to usually available watches.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A watertight watch casing comprising a back cover, a gasket of a preselected hardness mounted on said back cover, a case body overfitting said back cover and releasably connected thereto, said case body including a mounted crystal and a lug which may be pressured for releasing the connection between said case body and said back cover, said case body overlying said gasket, an upstanding support mounted on said back cover extending interiorly into said casing, and a flat configured spring mounted on said upstanding support, said spring having at least one raised portion, said case body having at least one interiorly ascending incline and at least one concomitant lateral overhang defining a groove on its interior side wall corresponding to said at least one raised portion of said flat spring, said incline having an angle of ascension having a predetermined relationship to said hardness of said gasket, said at least one raised portion of said spring being normally accommodated within said groove in said case body when said case body and said back cover are connected, said at least one raised portion of said spring being self-depressing during release and connection of said case body and back cover.

2. The watch casing as claimed in claim 1 wherein said at least one inclined groove in said case body has an angle of incline to the vertical of between about 5° to about 45°.

3. The watch casing as claimed in claim 1 wherein said gasket is characterized by a hardness of from about 40 to about 60 Mohs.

4. The watch casing as claimed in claim 1 wherein said flat spring is characterized by one raised portion having a chamfered top edge.

5. The watch casing as claimed in claim 1 wherein said flat spring is characterized by first and second raised portions having respective first and second chamfered top edges.

6. The watch casing as claimed in claim 1 wherein said flat spring includes opposed linear flanges, a pair of opposed obtusely inclined portions relative to said linear flanges and a substantially linear segment connecting said obtusely inclined segments which is substantially parallel to said flanges.

7. The watch casing as claimed in claim 1 wherein said flat spring includes linearly flanged opposed ends and two respective pairs of acutely angularly oriented interior segments, and a pair of respective linear segments for connecting said respective acute pairs of segments.

* * * * *